US010842696B1

(12) United States Patent
Wolpe

(10) Patent No.: US 10,842,696 B1
(45) Date of Patent: Nov. 24, 2020

(54) MOBILITY STRAP DEVICE

(71) Applicant: Toni Gay Davis Wolpe, Luling, LA (US)

(72) Inventor: Toni Gay Davis Wolpe, Luling, LA (US)

(73) Assignee: Toni Gay Davis Wolpe, Luling, LA (US)

( * ) Notice: Subject to any disclaimer, the term of this patent is extended or adjusted under 35 U.S.C. 154(b) by 0 days.

(21) Appl. No.: 16/574,011

(22) Filed: Sep. 17, 2019

(51) Int. Cl.
*A61G 7/053* (2006.01)
*A61G 7/00* (2006.01)
*A47C 21/00* (2006.01)

(52) U.S. Cl.
CPC ..... *A61G 7/0536* (2013.01); *A47C 21/00* (2013.01); *A61G 7/001* (2013.01)

(58) Field of Classification Search
CPC ..... A61G 7/0536; A61G 7/001; A47C 21/00
USPC ..... 5/662
See application file for complete search history.

(56) References Cited

U.S. PATENT DOCUMENTS 2,927,329 A * 3/1960 Johannis ..... A61G 7/0536 5/662
4,611,804 A * 9/1986 Addair ..... A63B 21/16 482/131
4,742,821 A * 5/1988 Wootan ..... A61F 5/3776 128/873
4,872,226 A * 10/1989 Lonardo ..... A61G 7/1023 5/81.1 T
4,956,218 A * 9/1990 Haining ..... A62C 8/06 169/50
4,998,308 A * 3/1991 Farago ..... A61F 5/3776 128/869
5,153,959 A * 10/1992 Fitzsimmons ..... A61G 7/0536 482/130
5,375,280 A * 12/1994 O'Sullivan ..... A47C 21/00 5/495
5,613,657 A * 3/1997 Olaiz ..... A61J 9/06 248/102
5,701,620 A * 12/1997 Montross ..... A47C 27/001 5/658
5,833,292 A * 11/1998 Lyons, Jr. ..... A45F 3/14 294/152
6,148,458 A * 11/2000 Hires ..... A47G 9/0246 5/485
6,209,768 B1 * 4/2001 Boaz ..... B60R 9/04 224/314
6,363,936 B1 * 4/2002 McCormick ..... A61G 1/044 128/870
6,772,764 B2 * 8/2004 Chapman ..... A61G 1/044 128/846

(Continued)

*Primary Examiner* — Myles A Throop
(74) *Attorney, Agent, or Firm* — Jacob Rothenberg

(57) ABSTRACT

Embodiments disclosed include devices for increasing bed mobility. A mobility strap apparatus includes a bed-strap; a fastening end coupled to the bed-strap; and a hand-grip coupled to the top surface of the bed-strap. Rigid affixing of the bed-strap to a bed provides stable support to users when moving or stabilizing oneself on a bed. A mobility strap grid provides a bed-strap configured to be longitudinally aligned with a bed; a bed-strap configured to be laterally aligned with the bed, intersecting and substantially perpendicular to the longitudinally aligned bed-strap; a fastening end coupled to a bed-strap; and a hand-grip coupled to the top surface of a bed-strap.

13 Claims, 5 Drawing Sheets

(56) References Cited

U.S. PATENT DOCUMENTS

| | | | | |
|---|---|---|---|---|
| 6,834,651 | B1 * | 12/2004 | Murdock | A47C 21/00 128/845 |
| 6,874,180 | B2 * | 4/2005 | Liao | A47C 15/008 5/482 |
| 7,707,666 | B2 * | 5/2010 | Calkin | A61G 3/0816 5/624 |
| 8,387,181 | B1 * | 3/2013 | Hansen | A61G 7/001 5/482 |
| 8,641,340 | B1 * | 2/2014 | Steinbock | B65D 90/006 410/97 |
| 8,936,253 | B1 * | 1/2015 | Rizzi | A61G 1/013 280/17 |
| 10,085,902 | B2 * | 10/2018 | Chia | A61G 1/044 |
| 2004/0087420 | A1 * | 5/2004 | Montesquieux | A63B 21/0552 482/129 |
| 2005/0172406 | A1 * | 8/2005 | Post | A61G 7/0504 5/626 |
| 2006/0213010 | A1 * | 9/2006 | Davis | A61G 7/0504 5/626 |
| 2008/0132392 | A1 * | 6/2008 | Moulton | A63B 21/0004 482/122 |
| 2012/0159715 | A1 * | 6/2012 | Jung | A47C 31/08 5/703 |
| 2013/0074270 | A1 * | 3/2013 | Caruso | A47C 21/00 5/658 |
| 2016/0256340 | A1 * | 9/2016 | Williams | A61G 7/001 |
| 2017/0296861 | A1 * | 10/2017 | Burkinshaw | A63B 71/02 |
| 2019/0290518 | A1 * | 9/2019 | Hatcher | A61G 7/0536 |

* cited by examiner

MOBILITY STRAP DEVICE

BACKGROUND OF THE INVENTION

1. Field of the Invention

The invention relates to a mobility assistance apparatus, and particularly to a mobility assistance bed strap.

2. Description of the Related Technology

Mobility assistance devices relate to equipment for aiding the mobility impaired. The mobility of a person may be impaired for a variety of reasons, such as injury, illness, or recovery from surgery. When a person's mobility is impaired, he or she may lack the ability to move normally, typically due to pain, decreased range of motion, weakness, or other conditions that hinder the normal operation of the body.

Mobility assistance devices aim to improve mobility in certain settings or locations. Mobility in one's bed is one location that is of particular importance for many people, such as bedridden patients in hospitals and nursing homes. In addition, many hospitals are shortening hospitalization after major surgeries, resulting in an increasing number of mobility impaired people living at home and in assisted living facilities.

Various devices for increasing bed mobility are known in the art. One such device is a bed rail. Bed rails typically extend upward from the side of a bed, and are either supported by the floor, attached between the mattress and box spring, or stabilized by both. The rails offer increased stability, increased ability to move and adjust, and some can also prevent falling out of bed overnight. Although, the increased stability and movement is typically limited to reaching to the side of the bed. In addition, bed rails often limit the ease of entering and exiting the bed.

A bed rail device is shown in U.S. Pat. No. 9,427,088 B2 entitled, "Mobility Assistance Devices and Related Methods," is expressly incorporated by reference herein and discloses a bed rail system in which base legs are inserted between a mattress and a box spring, and a support rail extends upward from the base legs. The support rail and base legs are configured to be reversibly arranged in a first orientation or a second orientation, for use on either side of a bed.

Another bed rail device is shown in U.S. Pat. No. 5,471,689 entitled, "Bed Handle System," is expressly incorporated by reference herein and shows a pair of handle elements, used for facilitating movement into and out of a bed. Each handle element can be anchored to a bed mattress and has an upwardly extending handle section dimensioned to extend above the bed mattress. In use the handle portion is positioned adjacent a first side of the mattress, and the pair of handle elements are positioned in spaced relation to each other. The spacing between the handle elements may be adjusted to permit a user to grasp one handle section with each hand and to sit between the elements on the mattress preparatory to moving into or out of the bed.

Another device for increasing bed mobility known in the art is the overhead trapeze bar. This device typically hangs above the bed and provides a bar for stability and movement. Although, this device provides little assistance to those who have limited upper-body strength or range of movement. In addition, this device typically requires a great deal of dead-lift of weight from over-head.

An overhead trapeze bar device is shown in U.S. Pat. No. 4,686,727 entitled, "Convenience Bar Assembly for Hospital Bed," is expressly incorporated by reference herein and discloses a generally U-shaped member including two arms adapted for generally vertical orientation and a horizontal cross-member connecting the arms. The lowermost ends of the arms of the U-shaped member are attached to opposite sides of a bed so that the horizontal member is oriented over the bed transversely. A horizontal support bar is swingably connected to the horizontal cross member so that the horizontal support bar hangs below the horizontal cross member when the horizontal support bar is at rest.

Another overhead trapeze bar device is shown in U.S. Pat. No. 9,089,461 B1 entitled, "Mobility and Comfort Auxiliary Bed Apparatus," is expressly incorporated by reference herein and shows two spaced apart and parallel frame bars, each with opposed vertical risers and a longitudinal rail that is positionable over a bed. An overhead grip (such as a trapeze bar) may be movably supported by the frame bars.

A third device for increasing bed mobility known in the art is the strap attached to the foot of a bed. This device is effective for allowing one to go from a laying down position to a sitting up position by pulling on the strap, which is attached to the bed frame at the foot of the bed. This device is typically not advantageous for assistance in movement besides moving from a laying down position to a sitting up position. For example, this device ordinarily does not assist in lateral movement. A strap attached to the foot of a bed is shown in U.S. Pat. No. 2,843,858 A, entitled, "Lift Strap and Exerciser for Recumbent Persons," is expressly incorporated by reference herein and discloses an attachment to the foot of a bed which can be used by a recumbent person to raise himself to a sitting position.

There remains a need for a bed mobility device that can offer increased stability, ability to move, and ability to adjust for a variety of needs, such as getting in and out of bed, sitting up or laying down in bed, moving or turning over in bed, or accomplishing any other movement-based task, such as stretching or physical therapy. In addition, there is a need for such a device that allows one to accomplish these tasks from a variety of positions on the bed. Further, it would be advantageous to have such a device that could minimally protrude from the bed to such a degree that one could lay on top of, or roll over onto, the device without significant discomfort.

SUMMARY OF THE INVENTION

The present invention discloses a mobility strap and a mobility strap grid. According to an advantageous feature of an embodiment of the invention, the mobility strap and mobility strap grid provides mobility, stability, and support for a wide variety of needs. In some embodiments, these needs can additionally be served from various locations on a bed.

According to an advantageous feature of an embodiment of the invention, mobility strap and mobility strap grid may service the aforementioned needs while also minimally protruding from the bed, such that one could comfortably sleep without removal.

A mobility strap may include a bed-strap having a top surface, bottom surface, and opposing longitudinal edges. According to an advantageous feature, the bed-strap bottom surface may be configured to be contiguous with the top surface of a bed to promote comfort of the person. The mobility strap may also include a fastening end coupled to the bed-strap. According to an advantageous feature, the fastening end may be configured to provide rigid affixing of the bed-strap to a bed such that the bed-strap remains substantially stationary when pulled by a person on the bed.

In addition, mobility strap may also include hand-grip coupled to the top surface of the bed-strap, the hand-grip being attached at two or more points to form at least one loop with the bed-strap. An advantageous feature provides that the hand-grips are configured to be of sufficiently unyielding structure to withstand the strong pulling of a hand, foot, or other body part.

Some embodiments of the mobility strap and mobility strap grid further comprise a pull-strap, configured to rely on the rigid affixing of the bed-strap to the bed to advantageously support pulling by a person on the bed. Some embodiments may further provide a pull-strap connector for affixing a pull-strap to a portion of the bed-strap.

Some embodiments of the mobility strap and mobility strap grid further comprise a fixture rigidly affixed to the bed, configured to rigidly affix the bed-strap to the bed. According to an advantageous feature, the fixture may provide a constant point of contact between the mobility strap and the bed, such that the mobility strap can be replaced in the same position on the bed after being temporarily removed.

A mobility strap grid may include a bed-strap configured to be longitudinally aligned with a bed, having a top and bottom surface and opposing longitudinal edges. The mobility strap grid may also include a bed-strap configured to be laterally aligned with the bed, intersecting and substantially perpendicular to the longitudinally aligned bed-strap, having a top surface, bottom surface, and opposing longitudinal edges. According to an advantageous feature, the bed-straps' bottom surface may be configured to be contiguous with the top surface of the bed to promote comfort of the person.

The mobility strap grid may also include a fastening end coupled to a bed-strap. The fastening end may be coupled to either the longitudinally aligned or laterally aligned bed strap, depending on the requirements of the particular embodiment. The fastening end may be advantageously configured to provide rigid affixing of the bed-strap to a bed such that the bed-strap remains substantially stationary when pulled by a person on said bed. The mobility strap may also provide for a hand-grip coupled to the top surface of a bed-strap, the hand-grip being attached at two or more points to form at least one loop with the bed-strap. The hand-grip may be coupled to either the longitudinally aligned or laterally aligned bed strap, depending on the requirements of the particular embodiment. According to an advantageous feature, the hand-grip may be configured to be of sufficiently unyielding structure to withstand the strong pulling of a hand, foot, or other body part.

While the preferred embodiment is configured to provide that the user may affix the invention to a "bed," other embodiments are not excluded. For example, other embodiments may be configured to provide that the user affix the invention to a car-seat, couch, recliner, or any other suitable device. The term "bed" should also be broadly construed to include any size or type of bed, and includes all components of a bed. The term "affixed to opposing sides of a bed" is not limited to affixing of the bed-strap as shown in the preferred embodiment. The bed-strap may be affixed to any part of the bed, including the mattress and bed frame (including, but not limited to, the headboard, footboard, slats, base, legs, or rail), any object configured to be attached to the bed, or any object within the vicinity of the bed. In addition, the bed-strap may be affixed by fully encompassing the bed and attaching opposing ends of the bed-strap underneath the bed. Thus, the bed-strap may be "affixed" to the bed by virtue of the bed-strap being affixed to itself or another object.

The term "affixed to opposing sides of a bed" includes affixing by any manner suitable for the particular embodiment, and is not limited to that disclosed in the preferred embodiment. Methods of affixing may include, but is not limited to, clips, clasps, brackets, buckles, ratcheting device, tying, screws, bolts, nails, snap fits and tabs, adhesives and tapes, Velcro, rubber bands, rope/cords or string, hooks, rings, grommets or eyelets, buttons, molding/welding or bonding, or any other affixing technique, depending on the particular embodiment.

Illuminating devices may refer to any method of improving visibility, depending on the requirements of the particular embodiment. Examples of illuminating devices include, but is not limited to, LEDs or other light-emitting devices, reflective tape, glow in the dark tape or stitching, or the use of illuminating or reflective material for certain components. For example, hand-grips or bed-straps may be of an illuminating or reflective material.

The term "hand-grips" and any reference to the "hand" may also include the foot or any other body part, depending on the requirements of the particular embodiment. For example, "hand-grips" located near the foot of the bed may, in some embodiments, be used primarily by the foot. Thus, the invention is not limited to use by the hand.

The phrases "connected to" and "coupled to" refer to any form of interaction between two or more components, including mechanical, electrical, or other interaction. Two components may be connected or coupled to each other even though they are not in direct contact with each other. Thus, two components may be connected or coupled to each other through an intermediate component.

The term "substantially perpendicular," when referencing the relative orientation of objects, refers to orientations that are respectively perpendicular to each other or differ from such an orientation by about 30 degrees or less.

Various objects, features, aspects, and advantages of the present invention will become more apparent from the following detailed description of preferred embodiments of the invention, along with the accompanying drawings in which like numerals represent like components.

Moreover, the above objects and advantages of the invention are illustrative, and not exhaustive, of those that can be achieved by the invention. Thus, these and other objects and advantages of the invention will be apparent from the description herein, both as embodied herein and as modified in view of any variations which will be apparent to those skilled in the art.

DETAILED DESCRIPTION OF THE PREFERRED EMBODIMENT

Figure 1:
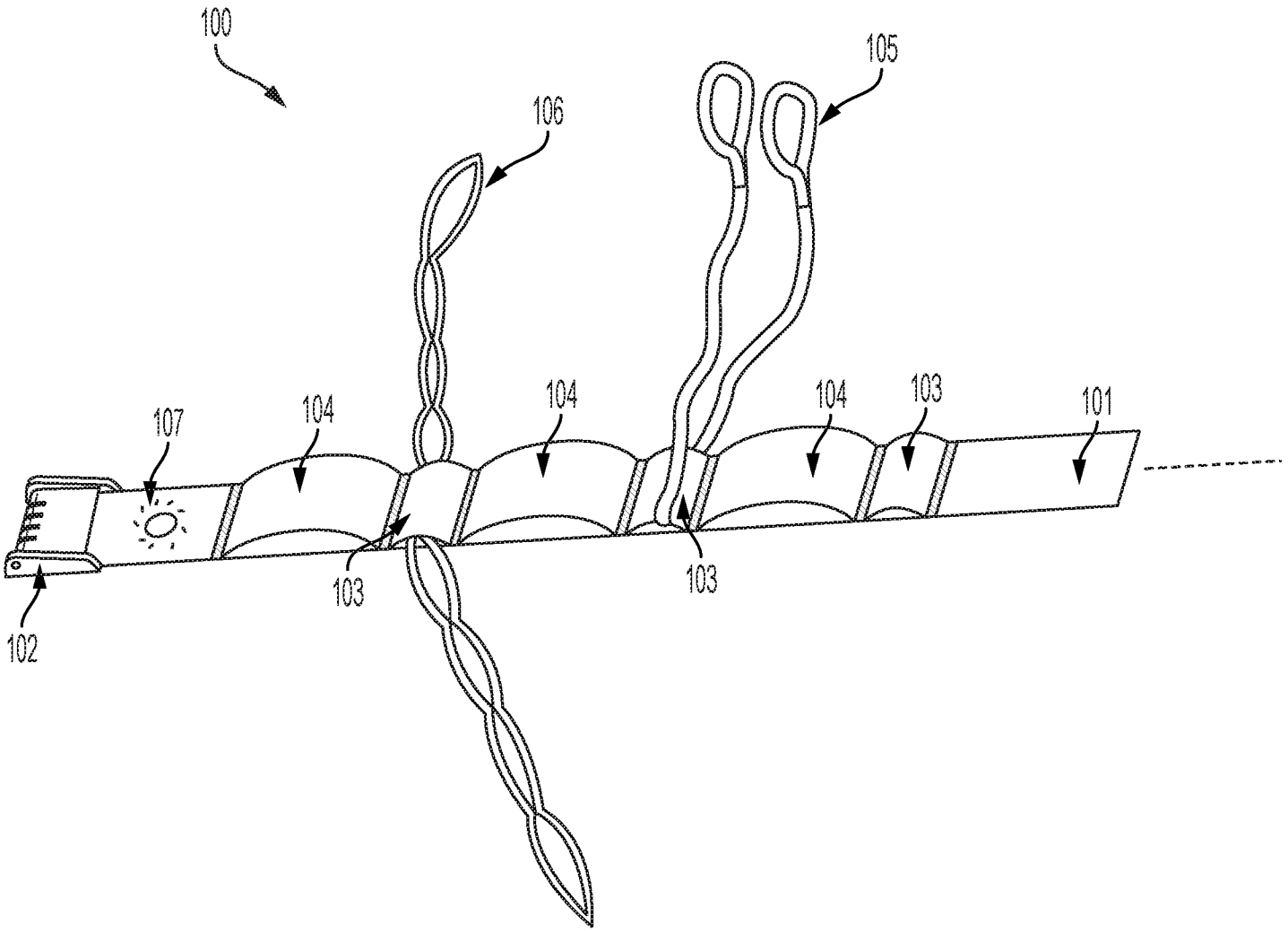
FIG. 1 shows a front perspective view of an embodiment of a mobility strap apparatus.

Before the present invention is described in further detail, it is to be understood that the invention is not limited to the particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It must be noted that as used herein and in the appended claims, the singular forms "a", "an", and "the" include plural referents unless the context clearly dictates otherwise.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates, which may need to be independently confirmed.

The present invention discloses a mobility strap and a mobility strap grid. According to an advantageous feature of an embodiment of the invention, the mobility strap and mobility strap grid provides improved mobility, improved stability, and support for a wide variety of needs. In some embodiments, these needs can additionally be served from various locations on a bed.

The system may rely on bed-straps to provide mobility and stability to a person on a bed. The bed-straps may be rigidly affixed to the bed in order to provide support when engaged. As discussed above, rigid affixing may be accomplished in a variety of ways, depending on the requirements of the particular embodiment. For example, the bed-strap may be affixed to the bed, which includes, but is not limited to the mattress and bed frame (including, but not limited to, the headboard, footboard, slats, base, legs, or rail). The bed-strap may also be affixed to any object configured to be attached to the bed, or any object within the vicinity of the bed (such as a platform or floor). In addition, the bed-strap may be affixed by encompassing the bed and attaching opposing ends of the bed-strap underneath the bed. Thus, the bed-strap may be "affixed" to the bed by virtue of the bed-strap being affixed to itself or another object.

The apparatus may also rely on hand-grips to provide improved mobility and stability. In some embodiments, hand-grips provide for improved mobility and stability to a variety of needs due to the multitude of hand-grips and adjustable nature of the bed-straps. Thus, in some embodiments, the bed-straps be optimally placed such that the hand-holds are in the desired position.

Referring to the drawings, FIG. 1 shows an embodiment of a mobility strap apparatus 100. The base of the mobility strap apparatus 100 is formed by a bed-strap 101. The bed-strap 101 may be of any suitable material, such as, but not limited to, textile, synthetic polyester, or nylon, depending on the requirements of the particular embodiment. According to an advantageous feature, the bed-strap 101 may be washable or cleanable.

In the embodiment shown in FIG. 1, a fastening end 102 is shown connected to the bed-strap 101. The fastening end 102 may accomplish the rigid affixing the bed. As discussed above, there are a variety of ways in which the bed-straps may be affixed. Methods of affixing by the fastening end 102 may include, but is not limited to, clips, clasps, brackets, ratcheting devices, buckles, tying, screws, bolts, nails, snap fits and tabs, adhesives and tapes, Velcro, rubber bands, rope/cords or string, hooks, rings, grommets or eyelets, buttons, molding/welding or bonding, or any other affixing technique, depending on the particular embodiment. In addition, multiple fastening ends 102 may be used, depending on the requirements of the particular application. The fastening end may be connected to an end or middle portion of the bed-strap 101, or may be connected to the bed-strap 101 in multiple places. In other embodiments, the fastening end 102 may be accomplished by using a bed-strap 101 capable of being tied to the bed. A tying fastening end 102 may be particularly advantageous when affixing to a bed that contains bed rails or a slatted footboard or headboard.

In the embodiment shown in FIG. 1, a pull-strap connector 103 is connected to the bed-strap 101. A pull-strap connector 103 may be used to provide a tubular portion through which a pull-straps 105 and 106 can be inserted. The user may then draw on the pull-strap 105 or 106 for increased mobility and stability. Pull-straps 105 and 106 may vary, depending on the requirements of the particular application. For example, different embodiments may provide different numbers (including none) and placements of loops. Pull-strap 105 shows a ribbon-like configuration that is easily configurable to the needs of the user. Pull-strap 105 could be engaged with the pull-strap connector 103, to the hand-grips 104, or to the bed-strap 101 itself.

In some embodiments, pull-straps 105 and 106 are also configured to have multiple modes of use for the user. For example, pull-strap 105 or 106 may be configured to be capable of being connected to a particular location, for example, by being tied to a particular pull-strap connector 103. Additionally, pull-strap 105 and 106 may also be capable of freely sliding along the bed-strap 101, for example by looping or loosely tying pull-strap 105 or 106 around or through the bed-strap 101, or by sliding the pull-strap 105 or 106 under the bed-strap 101. A user may also employ multiple modes of use in conjunction. For example, a user could both slide pull-strap 105 or 106 through the pull-strap connector 103 and place the looped end of the pull-strap 105 or 106 around the bed-strap 101 in order to provide additional support.

The pull-strap 106 features multiple loops, which allow the user to be able to draw on the pull-strap 106 at whichever point is most convenient. As discussed above, the pull-strap 106 may be used in whichever mode the user desires. For example, the user may place the pull-strap 106 through the pull-strap connector 103, underneath the bed-strap 101, through a hand-grip 104, or any other configuration that the user finds convenient.

FIG. 1 also depicts hand-grips 104. One or more hand-grips 104 are configured to be connected to the bed-strap 101, either directly or indirectly. As discussed above, in some embodiments the hand-grips 104 may additionally be used be feet or any other body part that the user finds convenient. For example, the user may place the bed-strap 101 towards the foot of the bed and use the hand-grips 104 to provide mobility or stability to the lower part of the body. According to an advantageous feature of an embodiment of the invention, the hand-grips 104 may be used of a non-rigid material to allow the user to comfortably lay on top of the mobility strap apparatus 100. The number and particular placement of the hand-grips 104 along the bed-strap 101 depend on the requirements of the particular embodiment.

The mobility strap apparatus 100 may also contain an illuminating device 107 in some embodiments. An Illuminating device 107 is configured to improve visibility. Examples of illuminating devices 107 include, but is not limited to, LEDs or other light-emitting devices, reflective tape, glow in the dark tape or stitching, or the use of illuminating or reflective material for certain components. For example, hand-grips or bed-straps may be of an illuminating or reflective material.

Figure 2:
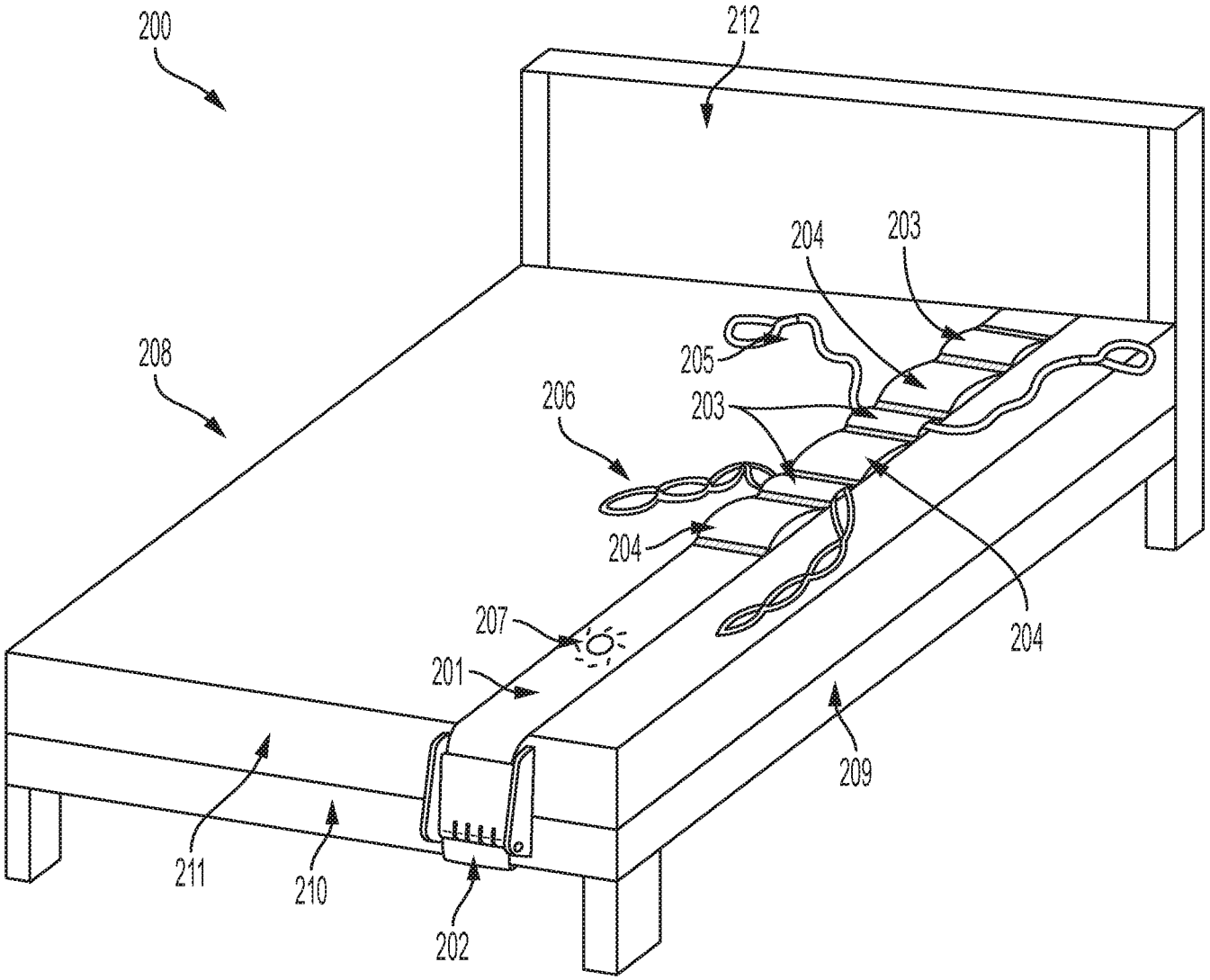
FIG. 2 shows a front perspective view of an embodiment of a mobility strap apparatus affixed to a bed.

FIG. 2 shows a mobility strap apparatus 200 affixed to a bed 208. The orientation of the mobility strap apparatus 200 and bed 208, is not limited to that shown in FIG. 2, and depends on the needs of the user.

As discussed above, this affixing of the mobility strap apparatus 200 to the bed 208 may be accomplished in a variety of ways, depending on the requirements of the particular embodiment. In the embodiment in FIG. 2, the mobility strap apparatus 200 is affixed by the ends of the bed-strap 201 encompassing the bed 208 and connecting by a fastening end 202. In this embodiment, the mobility strap apparatus 200 becomes affixed to the bed 208 by sufficiently tightening the mechanism of the fastening end 202. As discussed above, the precise mechanism employed depends on the requirements of the particular embodiment, may include, but is not limited to, clips, clasps, brackets, ratcheting devices, buckles, tying, screws, bolts, nails, snap fits and tabs, adhesives and tapes, Velcro, rubber bands, rope/cords or string, hooks, rings, grommets or eyelets, buttons, molding/welding or bonding, or any other affixing technique.

In other embodiments, the fastening end 202 may be configured to provide for affixing the bed-strap 201 to the footboard 210, headboard 212, bed frame 209, mattress 211, or any other part of the bed 208. The type of fastening end 202 used may depend on the requirements of the particular embodiment. For example, in applications that require frequent changing of sheets, it may be burdensome for the ends of the bed-strap 201 to fully encompass the bed 208, as shown in FIG. 2. In these applications, it may be more advantageous for one end of the mobility strap apparatus 200 to contain one or more non-releasable fastening ends 202 (such as screws or nails) that may be affixed to the footboard 210, headboard 212, bed frame 209, mattress 211, or any other part of the bed 208. In this embodiment, the mobility strap apparatus 200 may also provide for a releasable fastening end 202, such as a clasp, bracket, buckle. Thus, the releasable fastening end 202 could be released while the sheets are changed, while the non-releasable fastening end 202 maintains the affixing of the mobility strap apparatus 200 to the bed 208. According to an advantageous feature of this embodiment, the placement of the bed-strap 201 on the bed 208 is not altered while changing sheets. For example, a user may have placed the mobility strap apparatus 200 in such a position that the hand-grips 206 and pull-straps 205 and 206 are optimally placed for the requirements of the user. In this embodiment, the non-releasable fastening ends 202 may provide a constant point of contact between the mobility strap apparatus 200 to the bed 208 while changing sheets.

Figure 3:
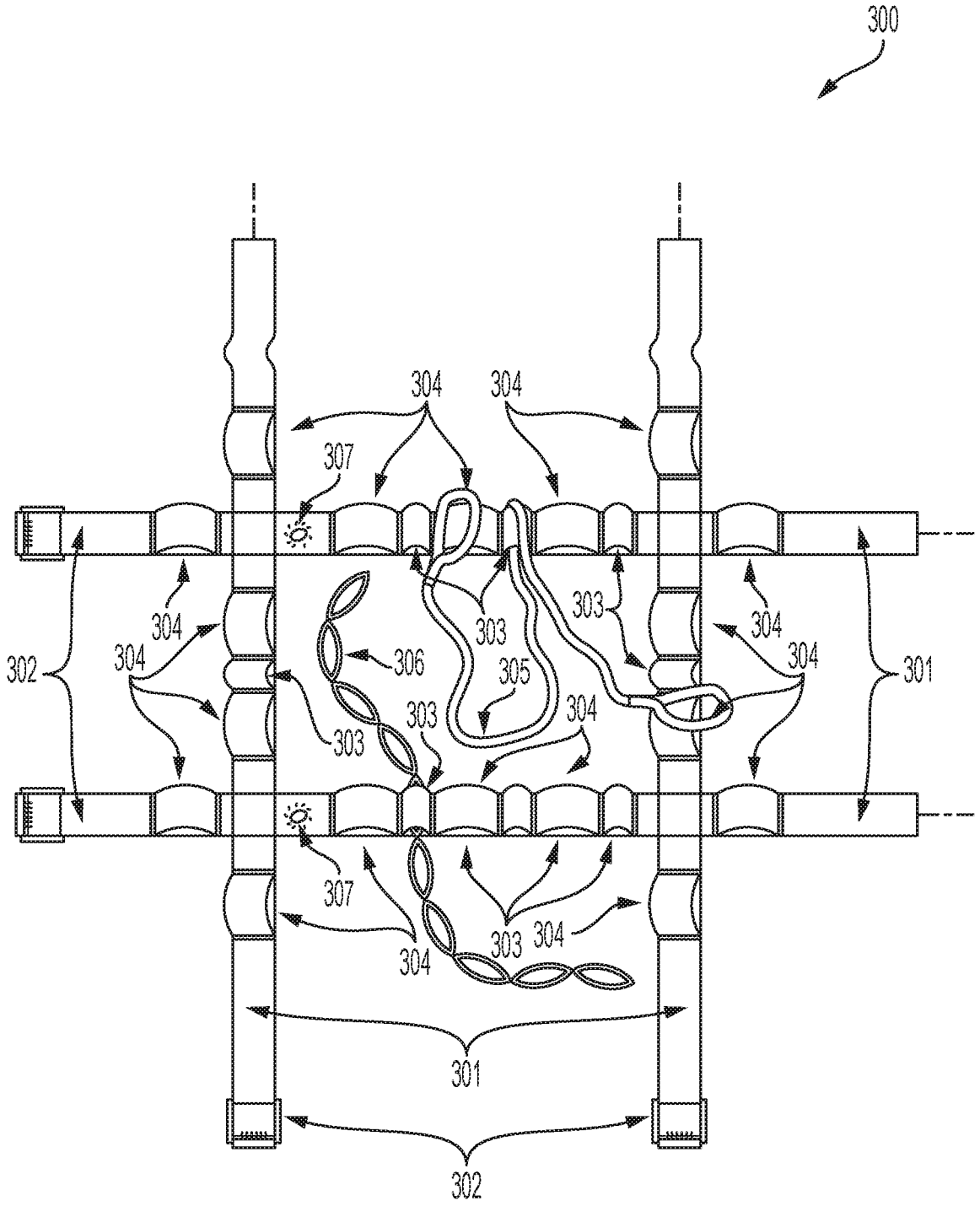
FIG. 3 shows a front perspective view of an embodiment of a mobility strap grid.

FIG. 3 shows an embodiment of the mobility strap grid 300. The mobility strap grid contains multiple bed-straps 301 aligned substantially perpendicular. In this embodiment, there are two longitudinal and two lateral bed-straps 301. More or fewer bed straps 301 may be used in other embodiments. Depending on the particular embodiment, the perpendicular bed-straps 301 may be connected to each other at crossing points, may not connect but be disposed through a portion of the other, or may not connect and simply be disposed over or underneath the other. For example, in applications that require more versatility for the user, the perpendicular bed-straps 301 be unconnected, such that the pull-strap connectors 303 and hand-grips 304 may be more readily adjusted on those bed-straps 301.

The mobility strap grid 300 provides one or more hand-grips 304. Depending on the requirements of the particular embodiment, hand-grips 304 may be provided on only one or more laterally aligned bed-straps 301, only one or more longitudinally aligned bed-straps 301, or both the laterally and longitudinally aligned bed-straps 301.

In embodiments that contain pull-straps 305 and 306 and pull-strap connectors 303, pull-strap connectors 303 may be provided on only the laterally aligned bed-straps 301, only the longitudinally aligned bed-straps 301, or both the laterally and longitudinally aligned bed-straps 301.

The embodiment in FIG. 3 shows each bed-strap 301 containing one fastening end 302. In other embodiments, some bed-straps 301 may contain multiple fastening ends 302, or may not contain fastening ends 302. For example, one embodiment may provide that only one or more longitudinally aligned bed-straps 301 contain fastening ends 302, or that only one or more laterally aligned bed-straps 301 contain fastening ends 302, or both. In addition, bed-straps 301 may contain different types of fastening ends 302, depending on the requirements of the particular embodiment. For example, the longitudinally aligned bed-straps 301 may contain non-releasable fastening ends 302 (such as the screwing or nailing of the mobility strap grid 300 into the bed), while the laterally aligned bed-straps 301 may contain releasable fastening ends 302 (such as such as clasps, brackets, buckles), or no fastening ends 302. One or more illuminating devices 307 may also be provided in some embodiments.

Figure 4:
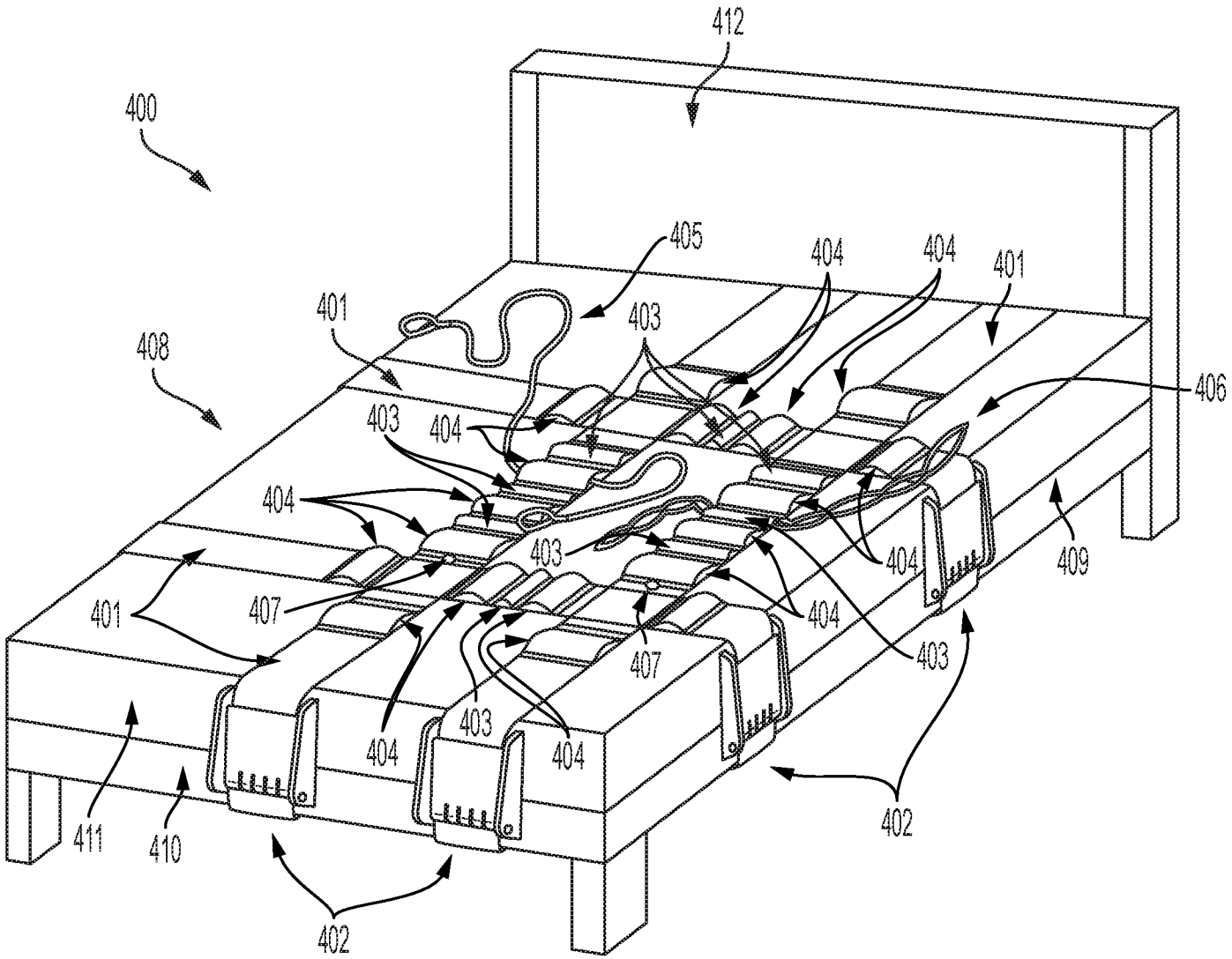
FIG. 4 shows a front perspective view of an embodiment of a mobility strap grid affixed to a bed.

FIG. 4 shows an embodiment of the mobility strap grid 400 affixed to a bed 408. In this embodiment, there are two longitudinal and two lateral bed-straps 401. Longitudinal bed-straps may be configured to run along the length of the bed 408, while lateral bed-straps may be configured to run across the width of the bed 408. For example, FIG. 4 shows two longitudinal bed-straps 401 running between the head 412 and foot 410 of the bed 400, and two lateral bed-straps 401 running across the sides of the bed 408. As discussed above, while the embodiment depicted in FIGS. 3 and 4 provide for four identical fastening ends 402, the number and type of fastening ends 402 depend on the requirements of the particular embodiment. In addition, one or more fastening ends 402 may be coupled to either longitudinally aligned or laterally aligned bed straps 401, or both, depending on the requirements of the particular embodiment.

In other embodiments, one or more of the fastening ends 402 may be affixed to the bed 408 by tying. As discussed above, tying fastening ends 402 may be particularly advantageous when the bed 408 contains bed rails or slatted footboards or headboards. FIG. 4 shows hand-grips 404 coupled to each bed-strap 401. As discussed above, hand-grips 404 may be provided on only one or more laterally aligned bed-straps 401, only one or more longitudinally aligned bed-straps 401, or both the laterally and longitudinally aligned bed-straps 401. The embodiment in FIG. 4 also provides pull-straps 305 and 306 and pull-strap connectors 403. One or more illuminating devices 407 may also be provided in some embodiments.

Figure 5:
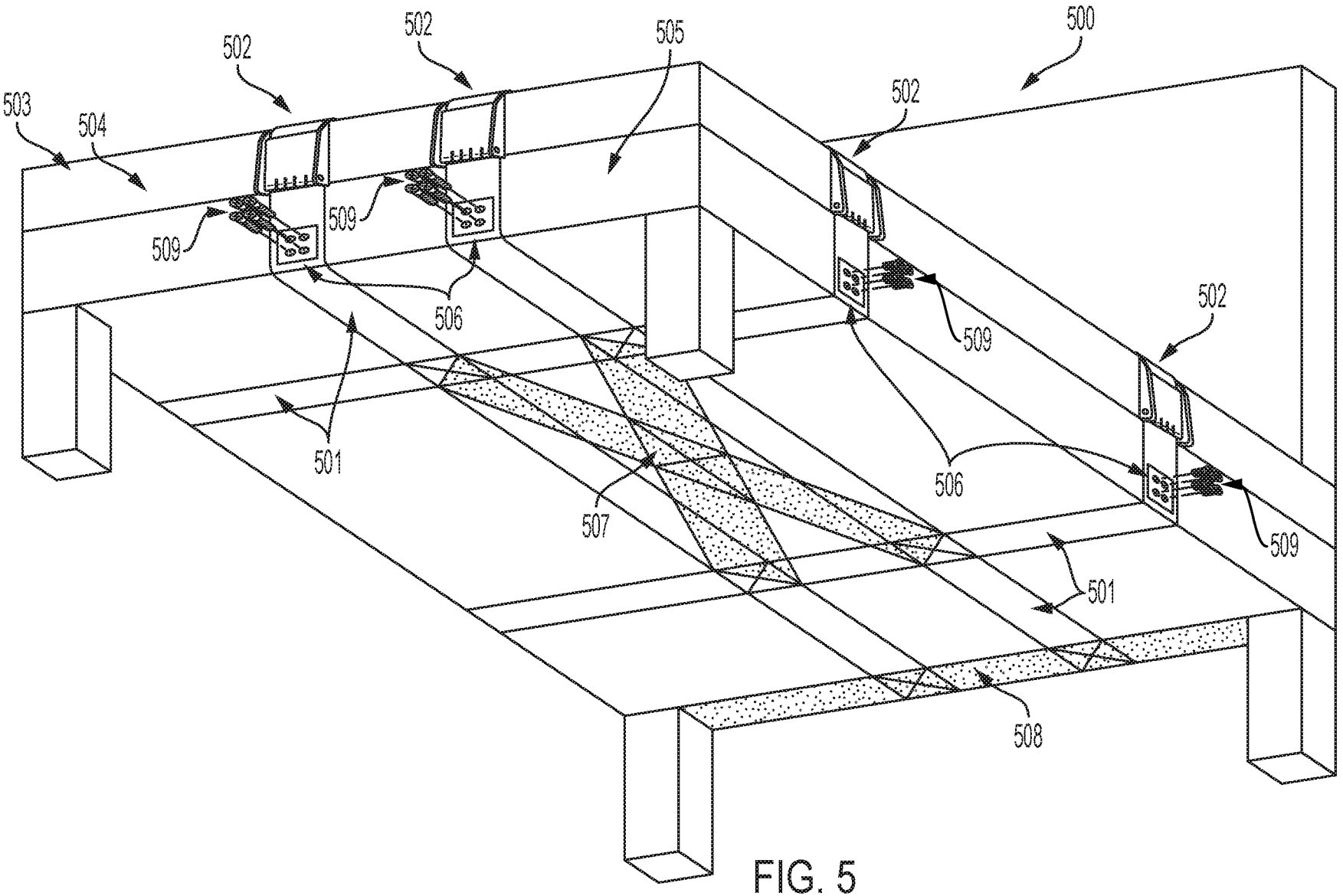
FIG. 5 shows a bottom perspective view of an embodiment of a mobility strap grid affixed to a bed.

Referring to FIG. 5, there is shown a bottom perspective view of an embodiment of the mobility strap grid 500. In this embodiment, two longitudinal and two lateral bed-straps 501 are affixed to the bed 503 by four releasable fastening ends 502. Support straps 507 and 508 are configured to further strengthen the affixing of the bed-straps to the bed. In one embodiment, support straps 507 provide support by engaging with the bed-straps 501. In FIG. 5, support straps 507 are provided underneath the bed 503 and cross to support each bed-strap 501. In other embodiments, support straps 508 may be additionally engaged with the bed 503. In FIG. 5, support strap 508 engages with both the bed-straps 501 and two legs of the bed 503. In other embodiments, the support straps 508 could be engaged with more or less than two legs. Additionally, the support straps 508 could be engaged with other parts of the bed 503.

In the embodiment in FIG. 5, fixtures are affixed to the bed 503. Fixtures 506 may be used in order to assist fastenings ends 509 in affixing of the bed-straps 501 to the bed 503. The fixtures 506 provided in FIG. 5 are plates affixed to the bed frame 505. Fastening end 509 screws are configured to rigidly affix the bed-straps 501 to the fixture 506, thereby rigidly affixing the bed-straps 501 to the bed 503. In other embodiments, fixtures 506 may be affixed to other parts of the bed 503, such as the mattress 504. In addition, other embodiments may not require one fixture 506 per bed-strap 501. Fixtures 506 may be permanently, semi-permanently, or temporarily affixed to the bed 503. For example, fixtures 506 could be screwed into the bed-frame 505, or in other embodiments, may be temporarily held to the bed-frame 505 by a releasable clasp. In addition, fixtures 506 may be engaged with the bed 503 either directly or indirectly, and to various parts of the bed 503, depending on the requirements of the particular embodiment. For example, fixtures 506 may be directly engaged to the bed-frame 505, or the bed-strap 503 may be disposed between the fixture 506 and the bed-frame 505.

As discussed above, some embodiments may provide multiple components for affixing the bed-strap 501 to the bed 503. In the embodiment of FIG. 5, both releasable fastening ends 502 and fastening ends 509 are used. The fastening ends 509 are used in conjunction with the fixture, while the releasable fastening ends 502 are not. According to an advantageous feature of this embodiment, additional rigid affixing of the bed-straps 501 to the bed 503 is provided by the fixtures 506 and fastening ends 509, while additional versatility and adaptability is provided by the releasable fastening ends 502.

The invention is described in detail with respect to preferred embodiments. It will be apparent to those skilled in the art that certain changes and modifications may be made without departing from the invention in its broader aspects, and the invention, therefore, as defined in the claims, is intended to cover all such changes and modifications that fall within the true spirit of the invention.

Thus, specific apparatus for a mobility strap and mobility strap grid have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A mobility strap apparatus, comprising:

a bed-strap having a top surface, bottom surface, and opposing longitudinal edges, wherein the bed-strap bottom surface is configured to be advantageously contiguous with the top surface of a bed;

a fastening end connected to the bed-strap;

a hand-grip coupled to the top surface of the bed-strap at two or more points to form at least one loop with the bed-strap; and a pull-strap, engageable and disengageable with a pull-strap connector, the bed-strap, and the hand-grip;

the pull-strap connector coupled to the top surface of the bed-strap, wherein the pull-strap connector comprises a tubular portion opening through which the pull-strap can be inserted for affixing a pull-strap to a portion of the bed-strap, wherein the tubular portion opening comprises a length along the bed-strap, and wherein the tubular portion opening length is less than the length of the loop formed by coupling the hand-grip to the bed-strap at two or more points.

2. The mobility strap of claim 1, further comprising a mounting fixture connected to the bed-strap.

3. The mobility strap of claim 1, wherein opposing ends of the bed-strap are coupled together.

4. The mobility strap of claim 1, wherein the hand-grip is of a curved shape.

5. The mobility strap of claim 1, further comprising illuminating devices affixed to said bed-strap.

6. The mobility bed-strap of claim 1, further comprising support straps connected to the bed-strap at two or more points.

7. A mobility strap grid, comprising:

a bed-strap configured to be longitudinally aligned with a bed, having a top surface, bottom surface, and opposing longitudinal edges, wherein the longitudinally aligned bed-strap bottom surface is configured to be advantageously contiguous with the top surface of the bed;

a bed-strap configured to be laterally aligned with the bed, intersecting and substantially perpendicular to the longitudinally aligned bed-strap, having a top surface, bottom surface, and opposing longitudinal edges, wherein the laterally aligned bed-strap bottom surface is configured to be advantageously contiguous with the top surface of the bed;

a fastening end connected to either the longitudinally aligned or laterally aligned bed-strap;

a hand-grip coupled to the top surface of either the longitudinally aligned or laterally aligned bed-strap at two or more points to form at least one loop with either the longitudinally aligned or laterally aligned bed-strap; and a pull-strap, engageable and disengageable with a pull-strap connector, the longitudinally aligned bed-strap, laterally aligned bed-strap, and hand-grip;

the pull-strap connector coupled to the top surface of either the longitudinally aligned or laterally aligned bed-strap, wherein the pull-strap connector comprises a tubular portion opening through which the pull-strap can be inserted for affixing a pull-strap to a portion of the bed-strap, wherein the tubular portion opening comprises a length along the bed-strap, and wherein the tubular portion opening length is less than the length of the loop formed by coupling the hand-grip to the bed-strap at two or more points.

8. The mobility strap grid of claim 7, further comprising a mounting fixture connected to the bed-strap.

9. The mobility strap grid of claim 7, wherein opposing ends of either the longitudinally aligned or laterally aligned bed-strap are coupled together.

10. The mobility strap grid of claim 7, wherein the hand-grip is of a curved shape.

11. The mobility strap grid of claim 7, further comprising illuminating devices affixed to either the longitudinally aligned or laterally aligned bed-strap.

12. The mobility strap grid of claim 7, further comprising support straps connected to either the longitudinally aligned or laterally aligned bed-strap at two or more points.

13. A mobility strap grid system, comprising:

a bed;

a bed-strap configured to be longitudinally aligned with the bed, having a top surface, bottom surface, and opposing longitudinal edges, wherein the bed-strap bottom surface is configured to be advantageously contiguous with the top surface of the bed;

a bed-strap configured to be laterally aligned with the bed, intersecting and substantially perpendicular to the longitudinally aligned bed-strap, having a top surface, bottom surface, and opposing longitudinal edges, wherein the laterally aligned bed-strap bottom surface is configured to be advantageously contiguous with the top surface of the bed;

a fastening end connected to either the longitudinally aligned or laterally aligned bed-strap;

a hand-grip coupled to the top surface of a either the longitudinally aligned or laterally aligned bed-strap at two or more points to form at least one loop with either the longitudinally aligned or laterally aligned bed-strap; and a pull-strap, engageable and disengageable with a pull-strap connector, the longitudinally aligned bed-strap, laterally aligned bed-strap, and hand-grip;

the pull-strap connector coupled to the top surface of either the longitudinally aligned or laterally aligned bed-strap, wherein the pull-strap connector comprises a tubular portion opening through which the pull-strap can be inserted for affixing a pull-strap to a portion of the bed-strap, wherein the tubular portion opening comprises a length along the bed-strap, and wherein the tubular portion opening length is less than the length of the loop formed by coupling the hand-grip to the bed-strap at two or more points.

* * * * *